US009601866B1

(12) United States Patent
Petersen et al.

(10) Patent No.: US 9,601,866 B1
(45) Date of Patent: Mar. 21, 2017

(54) STRAIN RELIEF AND JOINT SUPPORT

(71) Applicant: Elemental LED, Inc., Emeryville, CA (US)

(72) Inventors: Russell Petersen, Alameda, CA (US); Andrew Flesher, Oakland, CA (US)

(73) Assignee: Elemental LED, Inc., Emeryville, CA (US)

( * ) Notice: Subject to any disclaimer, the term of this patent is extended or adjusted under 35 U.S.C. 154(b) by 0 days.

(21) Appl. No.: 15/206,887

(22) Filed: Jul. 11, 2016

(51) Int. Cl.
*H01R 13/58* (2006.01)
*H01R 43/26* (2006.01)
*H01R 13/62* (2006.01)

(52) U.S. Cl.
CPC ..... *H01R 13/58* (2013.01); *H01R 13/62* (2013.01); *H01R 43/26* (2013.01)

(58) Field of Classification Search
CPC .... H01R 4/646; H01R 13/58; H01R 13/4223; H01R 13/658; H01R 4/185; H01R 4/20; F21Y 2101/02; F21Y 2103/00; F21K 9/00
USPC .... 439/98, 452, 595, 607.48, 752, 877, 879; 362/217.01, 217.13, 225
See application file for complete search history.

(56) References Cited

U.S. PATENT DOCUMENTS 2,768,361 A 10/1956 Aquillion et al.
3,670,290 A 6/1972 Angele et al.
3,743,748 A 7/1973 Reeder
3,944,312 A 3/1976 Koenig
4,142,771 A * 3/1979 Barnes ..... H01R 4/184 174/84 C
4,295,696 A 10/1981 Gray
4,295,698 A * 10/1981 Chow ..... H01R 13/4223 439/595
4,641,902 A * 2/1987 Fusselman ..... H01R 13/6581 439/350
4,707,914 A 11/1987 Schauer
4,768,969 A 9/1988 Bauer et al.
4,952,177 A 8/1990 Drake et al.
5,273,459 A * 12/1993 Davis ..... H01R 13/65802 439/607.48
5,409,400 A * 4/1995 Davis ..... H01R 13/6593 439/607.48
5,431,578 A * 7/1995 Wayne ..... H01R 13/193 439/259
5,505,637 A * 4/1996 Kramer ..... H01R 13/6593 439/467
5,820,412 A * 10/1998 Koegel ..... H01R 13/6593 439/607.51
(Continued)

*Primary Examiner* — Thanh Tam Le
(74) *Attorney, Agent, or Firm* — PatentBest; Andrew McAleavey

(57) ABSTRACT

A joint support and strain relief that provides support for the entire joint between a power cord and a strip light is disclosed. The joint support and strain relief is comprised of a cuff portion that defines a curved interior channel designed to cradle a power cord and a contiguous spade portion in the form of a thin, flat, generally rectangular plate. The strip light is typically secured to the spade portion with adhesive. The spade portion may have sidewalls to assist with the alignment of the strip light, and those sidewalls may have attached to their upper edges horizontally inwardly-extending tabs parallel to and above the bottom of the spade portion. The joint support and strain relief may also have tabs with holes or openings that allow the piece to be attached to a substrate.

10 Claims, 7 Drawing Sheets

(56) References Cited

U.S. PATENT DOCUMENTS 5,993,268 A * 11/1999 Yamaguchi ..... H01R 13/432 439/746
6,283,612 B1 9/2001 Hunter
6,406,337 B1 6/2002 Machado
7,121,903 B2 * 10/2006 Sakaguchi ..... H01R 4/185 439/877
7,175,303 B2 2/2007 Kovacik et al.
7,241,190 B2 * 7/2007 Smyk ..... H01R 13/187 439/852
7,473,006 B1 1/2009 Bollman
7,540,773 B2 6/2009 Ko
7,575,362 B1 * 8/2009 Hsu ..... H01R 33/09 362/647
7,601,037 B2 * 10/2009 Telakowski ..... H01R 4/186 439/879
7,695,321 B2 * 4/2010 Cayzac ..... H01R 13/5219 439/607.41
7,976,351 B2 * 7/2011 Boemmel ..... H01R 13/432 439/748
8,167,477 B2 * 5/2012 Chung ..... H01R 4/48 362/652
8,231,261 B2 7/2012 Gherardini et al.
8,337,238 B2 * 12/2012 Tobey ..... H01R 9/035 439/460
8,714,772 B1 * 5/2014 Levante ..... F21V 23/06 362/217.17
8,727,816 B2 * 5/2014 Takahashi ..... H01R 13/4361 439/595
8,951,063 B2 2/2015 Iio
8,979,296 B2 3/2015 Wiemer et al.
8,979,583 B2 * 3/2015 Furuya ..... H01R 13/428 439/595
9,206,964 B2 12/2015 Marsh et al.
9,239,136 B1 1/2016 Petersen et al.
9,287,655 B2 3/2016 Sato et al.
9,374,856 B2 6/2016 Winton
2002/0106931 A1 8/2002 Hsien-Te
2008/0050988 A1 2/2008 Burger
2010/0008090 A1 1/2010 Li
2012/0002417 A1 1/2012 Li
2013/0249394 A1 9/2013 Fay
2015/0077998 A1 3/2015 Zhang
2015/0241035 A1 8/2015 Dankelmann et al.
2015/0285472 A1 10/2015 Evitt

* cited by examiner

STRAIN RELIEF AND JOINT SUPPORT

BACKGROUND OF THE INVENTION

1. Field of the Invention

The invention relates generally to light-emitting diode (LED) lighting, and more particularly to joint support and strain relief for connecting LED strip light to a cable.

2. Description of Related Art

Over the last decade, light-emitting diode (LED)-based lighting has become popular in both residential and commercial lighting applications because of its efficiency, adaptability, and its wide range of color and color temperature options. One of the most popular forms of LED light is the strip light—a long, flexible printed circuit board (PCB) with LED light engines connected to the PCB at a regular interval along its length. Strip light can be placed in long extrusions, which are typically covered by diffusers, to provide the same sort of form factor and light quality that a traditional fluorescent or incandescent fixture might, and it has a plethora of other uses. Backed by adhesive, strip light can adhere to essentially any surface, and is sometimes referred to as tape light. Depending on its type and operating voltage, a strip light may extend anywhere from a few meters to more than 50 meters.

U.S. Pat. No. 9,239,136 to Russell Petersen et al., the work of the present assignee and incorporated by reference in its entirety, illustrates and describes a typical configuration of strip light. As this patent bears out, one of the persistent challenges with strip light lies in connecting the strip light to power. The typical solution is simply to solder wires to the strip light. However, solder joints are fragile, and relying on a solder joint to provide both mechanical and electrical connection is inadvisable.

Moreover, while it might be easy to solder a connection in a factory, or in another controlled environment, power connections to strip light are often made either in the field by installers, typically electricians or laborers. Field installers often operate under time pressure with a limited toolset and in ambient conditions that may include dirt, dust, or other particulates that can foul a joint or connection. Making a proper, robust electrical and mechanical connection under these field conditions can be difficult, and if a connection is improper or fails, it can be equally difficult to trace the source of the failure during an installation.

In some cases, instead of soldering a wire directly, the wire may be connected to a terminal, such as a crimp terminal, and that terminal used to make any further electrical or mechanical connections. The Petersen patent, which was incorporated by reference above, shows one example of how terminals may be used in this context to make electrical and mechanical connections with individual wires. U.S. Pat. No. 8,951,063, which is incorporated by reference in its entirety, illustrates another example of a crimp terminal—in this case, a cuff that surrounds the end of the wire and makes electrical connection to it and a flat, annular connecting "spade" that extends outwardly and can be used to make further electromechanical connection.

While there are structures, like spade connectors, for connecting individual wires electrically and mechanically, there are relatively few solutions for providing mechanical support to an entire joint. One example of a mechanical joint support can be found in most consumer appliances: a molded plastic or rubber "strain relief" is often provided at the point where a power cable joins the element to which it is supplying power. The molded strain relief prevents the cable from bending too much at the point of connection and breaking off. However, this type of strain relief is typically an integral part of the cord, installed at manufacture, and it typically attaches a flexible cord to a rigid housing, rather than a flexible cord to a flexible PCB.

SUMMARY OF THE INVENTION

One aspect of the invention relates to a joint support and strain relief that is adapted to provide support for the entire joint between a power cord and a strip light. The joint support and strain relief is comprised of a cuff portion that defines a curved interior channel designed to cradle a power cord and a contiguous spade portion in the form of a thin, flat, generally rectangular plate. The strip light is typically secured to the spade portion with adhesive. In some embodiments, the spade portion may have sidewalls to assist with the alignment of the strip light, and those sidewalls may have attached to their upper edges horizontally inwardly-extending tabs parallel to and above the bottom of the spade portion. In some embodiments, the joint support and strain relief may also have tabs with holes or openings that allow the piece to be attached to a substrate. Other features, like setbacks in the sidewalls of the cuff portion, may be provided to increase access to the joint during installation or to provide an easy path for power and ground leads from the power cord. In contrast to most small, electrical spade connectors, the joint support and strain relief may be made of a nonconductive material, and that material may either be rigid or somewhat flexible.

Another aspect of the invention relates to methods for creating an electrical and mechanical joint between a power cord and a strip light. The methods comprise inserting a power cord into the cuff portion of the joint support and strain relief described above, and attaching a strip light to the spade portion of the joint support and strain relief described above. Depending on the embodiment, power and ground leads from the power cord may be soldered to contact pads on the strip light either before or after those components are placed in the joint support and strain relief. In other words, the joint support and strain relief may, in some cases, serve as an alignment tool and support while soldering takes place.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the figures, and in which.

DETAILED DESCRIPTION

Figure 1:
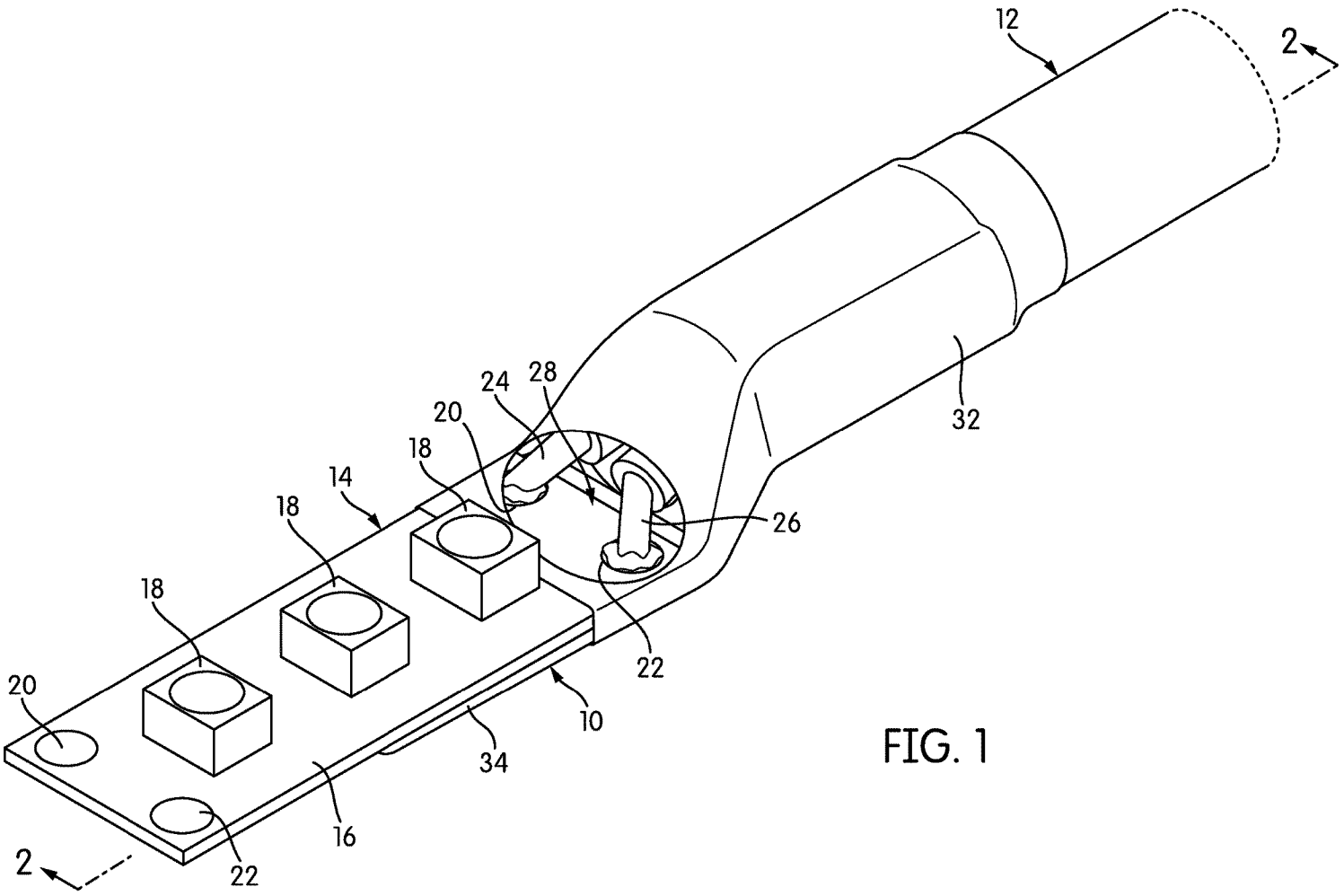
FIG. 1 is a perspective view of a joint support and strain relief for a strip light according to one embodiment of the invention, shown with strip light installed.
Figure 2:
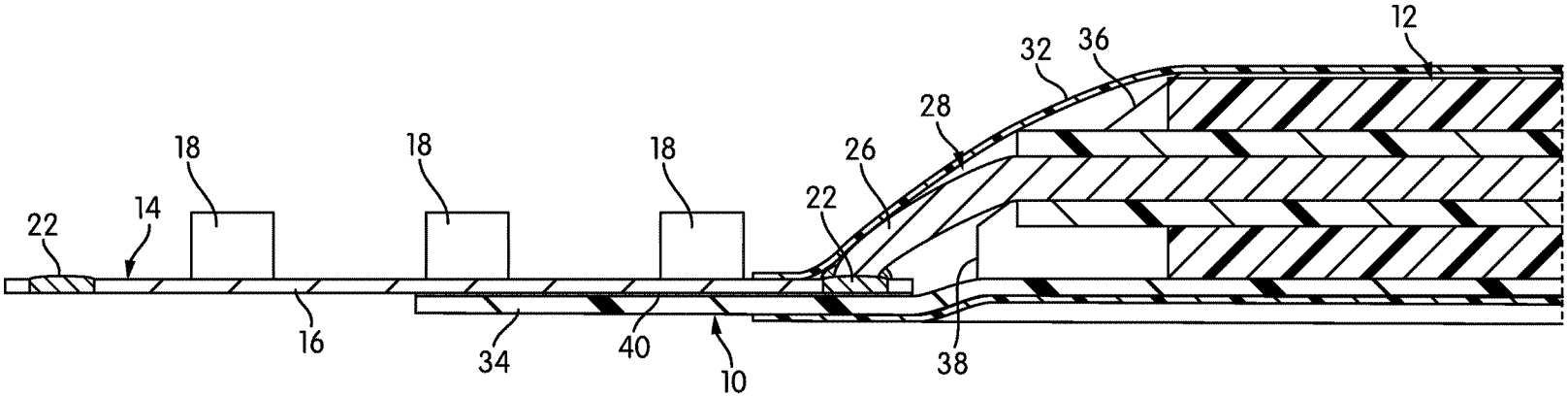
FIG. 2 is a cross-sectional view taken through Line 2-2 of FIG. 1.

FIG. 1 is a perspective view of a joint support and strain relief 10 that supports a joint between a power cable 12 and a strip light 14, and FIG. 2 is a cross-sectional view taken through Line 2-2 of FIG. 1.

The strip light 14 is of the type described above and typically has a flexible printed circuit board (PCB) substrate 16 on which a number of light-emitting diode (LED) light engines 18 are mounted at a regular interval along the length of the substrate 16. A typical strip light 14 would be comprised of a number of repeating units, each repeating unit having a number of the LED light engines 18, along with driver circuits, power conversion circuits, and any other circuitry necessary to drive or control the LED light engines 18. As shown in FIG. 1, each repeating unit typically has conductive contact pads 20, 22 for power and ground connections, respectively. The strip light 14 usually includes a number of repeating units. Repeating units may be, e.g., 1 inch (2.54 cm), 2 inches (5 cm), or 4 inches (10.1 cm) long. If a repeating unit is 1 inch long, the strip light 14 may be cut to a desired length at 1-inch intervals; if the repeating unit is 2 inches long, the strip light 14 may be cut to a desired length at 2-inch intervals, etc. Depending on the voltage at which the strip light 14 operates and other factors, it may be adapted to be field cut, with cut lines inscribed on the substrate 16 between repeating units. For simplicity in illustration, only a single repeating unit is shown in FIGS. 1 and 2.

As shown in FIGS. 1 and 2, the power cord 12 has separate power and ground leads 24, 26, which run through the cord 12 and are exposed at their ends, where they are soldered to the respective contact pads 20, 22, forming an electrical connection that provides the strip light 14 with power. The voltage at which the strip light 14 operates is not critical to the invention, and it may operate using either direct current (DC) or alternating current (AC). If the strip light 14 operates using AC current, each repeating unit may have its own rectifier or other such components to convert incoming AC power to DC, as disclosed in U.S. Provisional Patent Application No. 62/344,670, filed Jun. 2, 2016, the contents of which are incorporated by reference in their entirety. In one typical embodiment, the strip light 14 might operate at, for example, 12-24 VDC.

The connection between the power and ground leads 24, 26 and the contact pads 20, 22 is sufficient to convey power, but it is mechanically relatively fragile. Movement of the cord 12 relative to the substrate 14 could fatigue the joint over time or cause outright and immediate failure. For that reason, the joint support 10 supports both the power cord 12 and the substrate 16 of the strip light 14 around the joint 28 created between the two.

Figure 3:
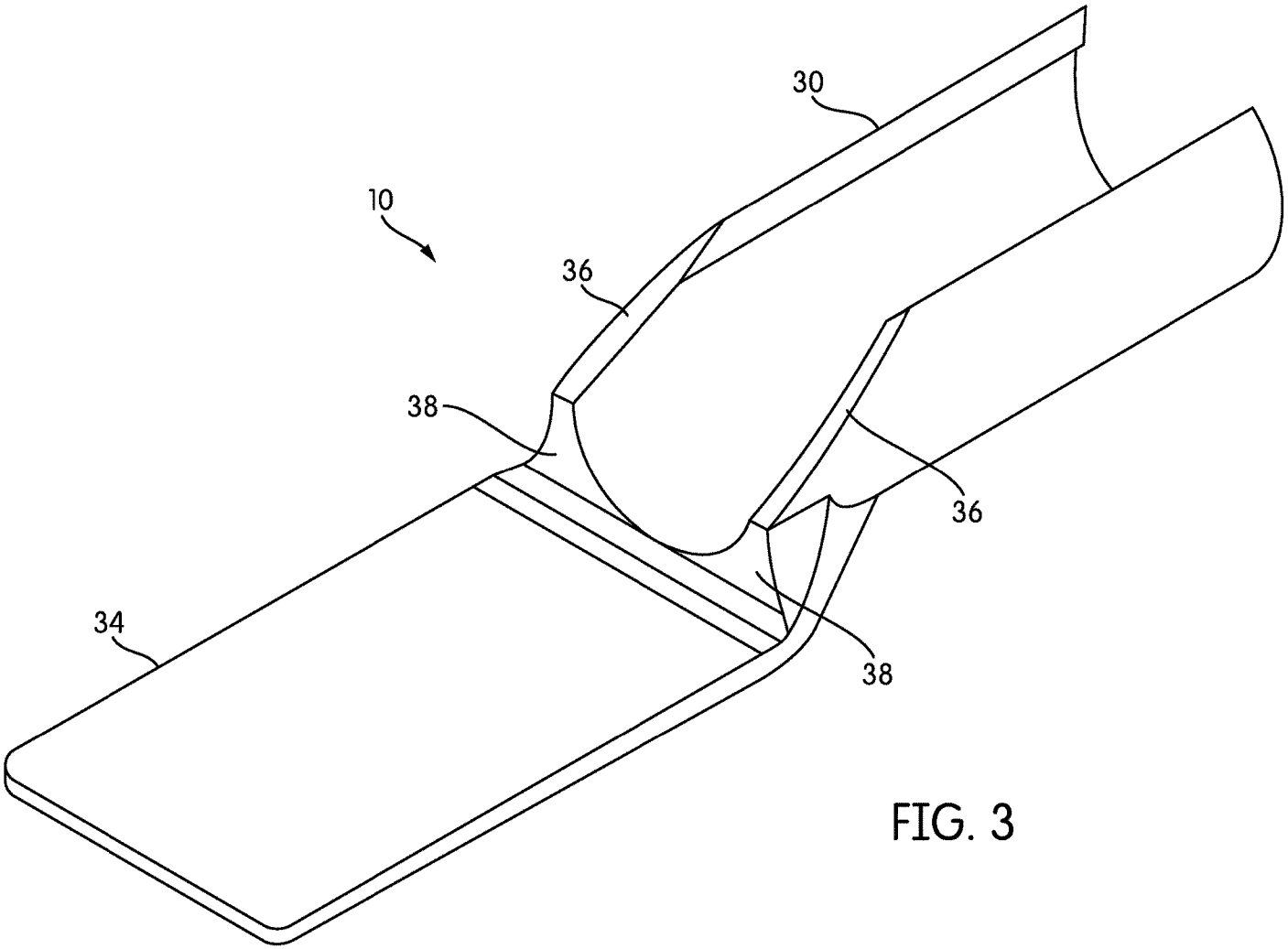
FIG. 3 is a perspective view of the joint support and strain relief of FIGS. 1-2 in isolation.

FIG. 3 is a perspective view of the joint support 10 in isolation. As can be seen in FIG. 3, the joint support 10 includes a cylindrical cuff portion 30 that is adapted to encircle the power cord 12. Typically, the sidewalls of the cuff portion 30 would extend over about 50% of the circumference of the power cord, but may extend 60-75% of the circumference of the power cord 12 or more, so long as enough of an opening exists to insert the power cord 12 into the cuff portion.

The cuff portion 30 is generally adapted to fit the power cord 12 with relatively little space or play between the two. In some embodiments, the sidewalls of the cuff portion 30 may be sized such that the connection between the two components 12, 30 is a snap fit—the cuff portion 30 can be snapped onto the power cord 12 and will not come off. The material of which the cuff portion 30 is made may be slightly resilient to allow the sidewalls to deflect slightly to admit the power cord 12. However, if a snap-fit connection is not desired, or if additional securement or weatherproofing is necessary or desired, the entire joint 28 can be covered by a shrink wrap 32, such as a heat shrink wrap. As shown in FIGS. 1 and 2, a shrink wrap 32 extends from a point on the power cord 12 some distance back from the joint 28 to a point on the strip light 14 just before the first LED light engine 18, covering the entire joint 28 along the way. While the cuff portion 30 is cylindrical and adapted to fit a round power cord 12 in the illustrated embodiments, cuffs with other complementary shapes could be made to fit oval or flattened power cords.

The cuff portion 30 of the joint support 10 is contiguous with, and transitions into, a flat, spade portion 34 adapted to attach to the substrate 16 of the strip light 14. The spade portion 34 typically has the same or nearly the same width as the strip light 14 itself (e.g., 8 mm, 10 mm, 12 mm, etc.), and is generally rectangular with rounded forward corners in the illustrated embodiment. Depending on the embodiment, the spade portion 34 may also be wider or narrower than the strip light 14 itself. As seen best in the cross-sectional view of FIG. 2, the joint support 10 makes a slight dip in the transition between the cuff portion 30 and the spade portion 34. This dip, typically roughly equal to the height of the substrate 16, allows the substrate 16 to line up with the bottom of the cuff portion 30. The spade portion 34 itself is generally kept as thin as possible, so that there is not a substantial vertical dip between the initial portion of the strip light 14 that is attached to the spade portion 34 and the remainder of the strip light 14. A substantial dip or change in height in that location could create a stress concentrator that would negatively impact the strip light 14.

In some embodiments, the spade portion 34 may taper in thickness as it extends outward from the cuff portion 30, such that the spade portion 34 is thinner at its forward end than it is at its origin adjoining the cuff portion 30.

As shown in FIG. 3, the forward part of the sidewalls of the cuff portion 30 have angled setbacks 36 to provide more access to the power and ground leads 24, 26. However, instead of tapering down completely, in the illustrated embodiment, the forward edges 38 of the cuff portion 30 descend vertically or nearly vertically, giving the setbacks 36 and forward edges 38 a trapezoidal shape in the cross-sectional view of FIG. 2.

One effect of these features can be seen in FIG. 2. The setbacks 36 and vertical forward edges 38 provide for a gentler transition for the shrink wrap 32, potentially making it more effective and less likely to stretch or tear on a sharp edge or transition. In addition, the setbacks 36 and vertical forward edges 38 provide more access to the joint 28.

The setbacks 36 vertical forward edges 38 are optional. The presence or absence of setbacks 36 and truncated, vertical forward edges 38 in any particular embodiment may depend upon how the joint support 10 is intended to be used. In some cases, the joint support 10 may be placed on the power cord 12 and the strip light 14 after the solder connection between the two has already been made, in which case, there may be no need for features that provide more access to the joint area of the joint support 10, particularly if shrink wrap 32 is not to be used. However, in other cases, the joint support 10 may be placed before the electrical connection is made, and may act to locate, hold, and secure the two parts 12, 14 relative to one another while the solder connection is made. In that case, setbacks 36 and truncated, vertical forward edges 38 may provide additional access for making that connection.

As shown in FIG. 2, the strip light 14 may be attached to the spade portion 34 by its own adhesive 40, if it is a tape light, by a bead or layer of applied adhesive, if it does not have its own adhesive. In some embodiments, the spade portion 34 may be covered with its own layer of adhesive, with a removable layer protecting the adhesive until use.

Figure 4:
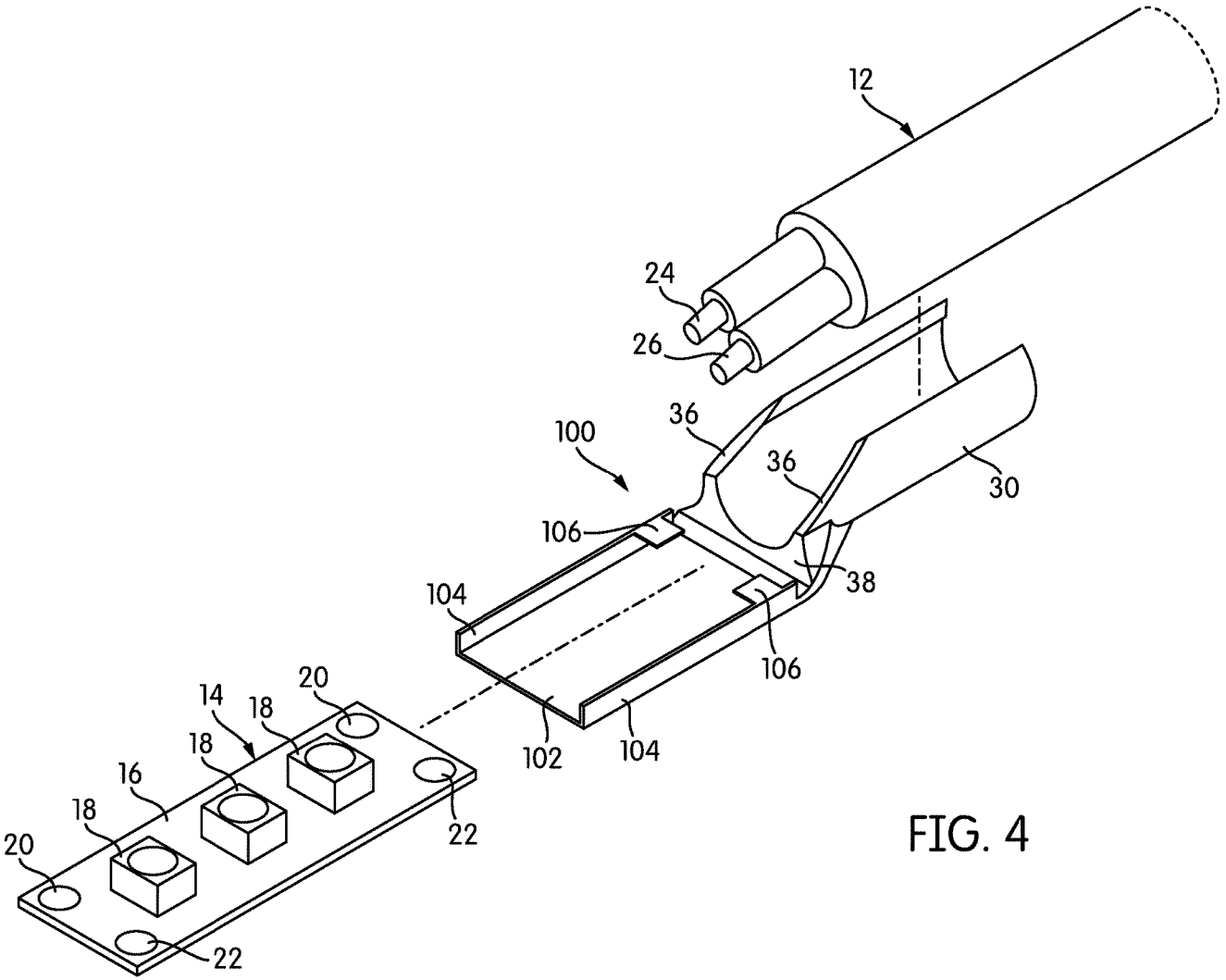
FIG. 4 is an exploded perspective view of a joint support and strain relief with wire and strip light.

In some cases, additional features may be provided to help an installer align the strip light 14 properly. FIG. 4 is an exploded perspective view illustrating a joint support 100 according to another embodiment of the invention with a power cord 12 and strip light 14. In the joint support 100, the cuff portion 30 is identical to the cuff portion 30 of the joint support 10 described above.

Figure 5:
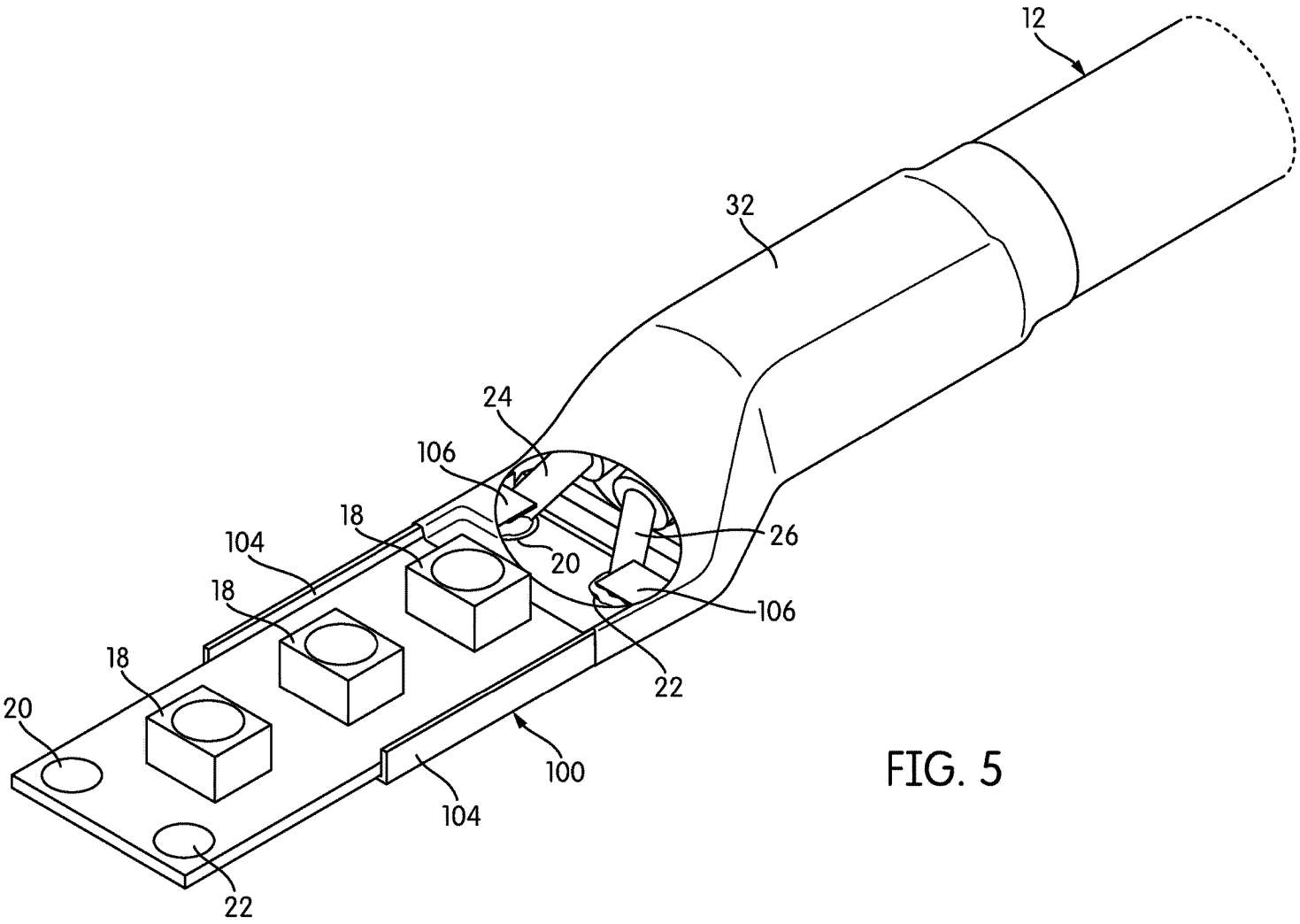
FIG. 5 is a perspective view of the joint support and strain relief of FIG. 4, shown as assembled with strip light.

The spade portion 102, however, has additional features. More specifically, the spade portion 102 has sidewalls 104 that rise vertically from its long edges. Proximal to the cuff portion 30 and extending horizontally inward from the tops of the sidewalls 104 are a pair of tabs 106. The sidewalls 104 and tabs 106 provide guides for installing the strip light 14 within the spade portion 102. In essence, the sidewalls 104 provide a channel for inserting the strip light 14. If desired, more than one pair of tabs 106 may be provided or continuous inward flanges could be used instead of tabs 106. FIG. 5 is an assembled perspective view of the joint 100.

Figure 6:
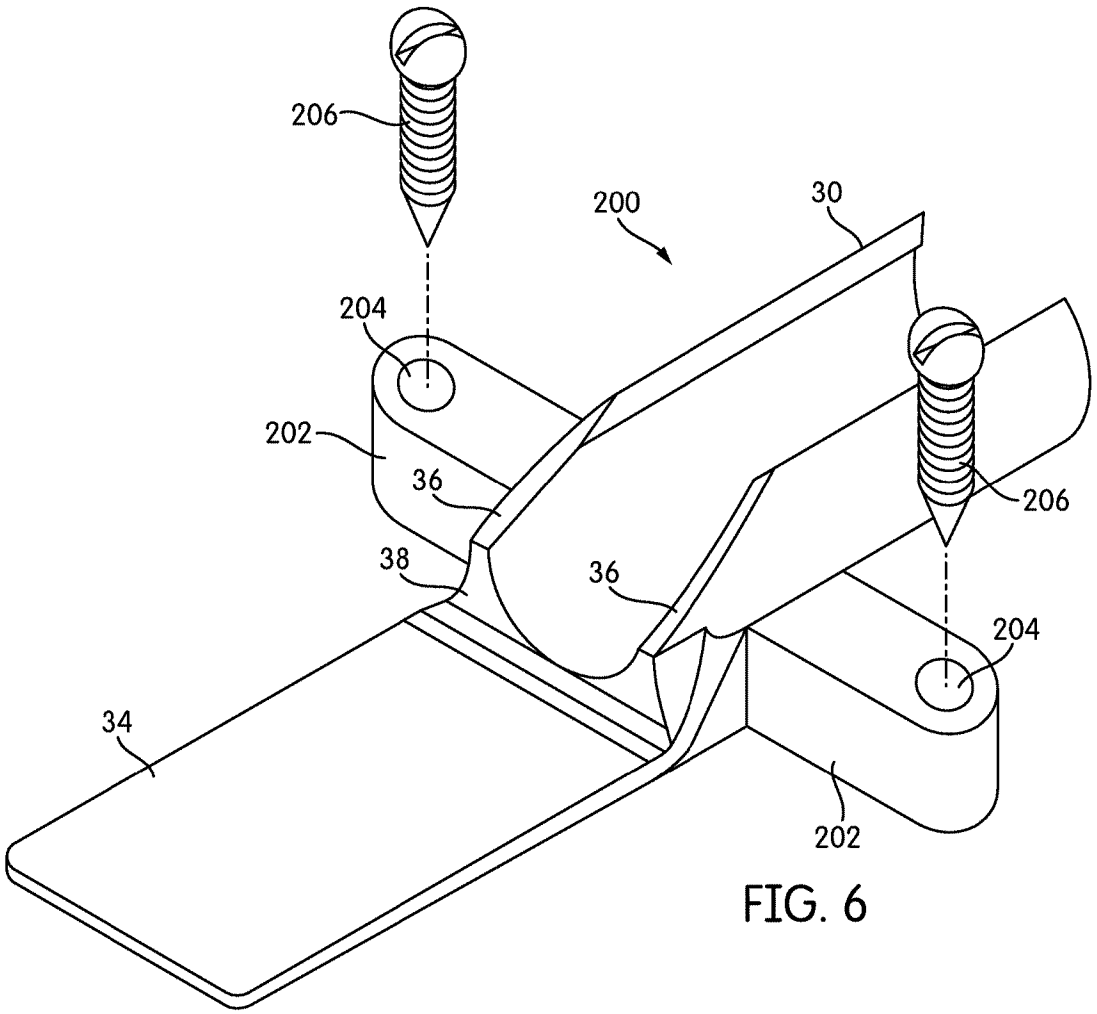
FIG. 6 is a perspective view of a joint support and strain relief with one type of external attaching structure to attach it to a substrate.

In many cases, the joint between the cable 12 and the strip light 14 will be an opportune place to attach to a substrate. For that reason, some embodiments of the invention may be equipped with features to facilitate attachment of the joint support to various substrates. FIG. 6 is a perspective view of another embodiment of the joint support and strain relief, this one generally indicated at 200. In addition to the cuff portion 30 and the spade portion 34 found in other embodiments, the joint support 200 includes a pair of outwardly extending tabs 202, each tab 202 attached to the side of the joint support 200 along the cuff portion 30. The tabs 202 have through holes 204 through which fasteners 206 can be inserted to secure the joint support 200 to a substrate. Depending on the substrate, the fasteners 206 may be wood screws, machine screws, nails, or any other suitable type of fastener. Of course, fasteners are not the only way in which a joint support 10, 100, 200 may be attached to a substrate. In other embodiments, for example, adhesive may be applied to the underside of the joint support 10, 100, 200.

The joint support 200 illustrates another principle: while the interior of the cuff portion 30 has curved sidewalls to cradle a power cord 12, the shape of the exterior sidewalls and bottom of the cuff portion 30 is not critical, and may be chosen to suit other factors. The exterior sidewalls may be squared, for example, instead of curved.

Figure 7:
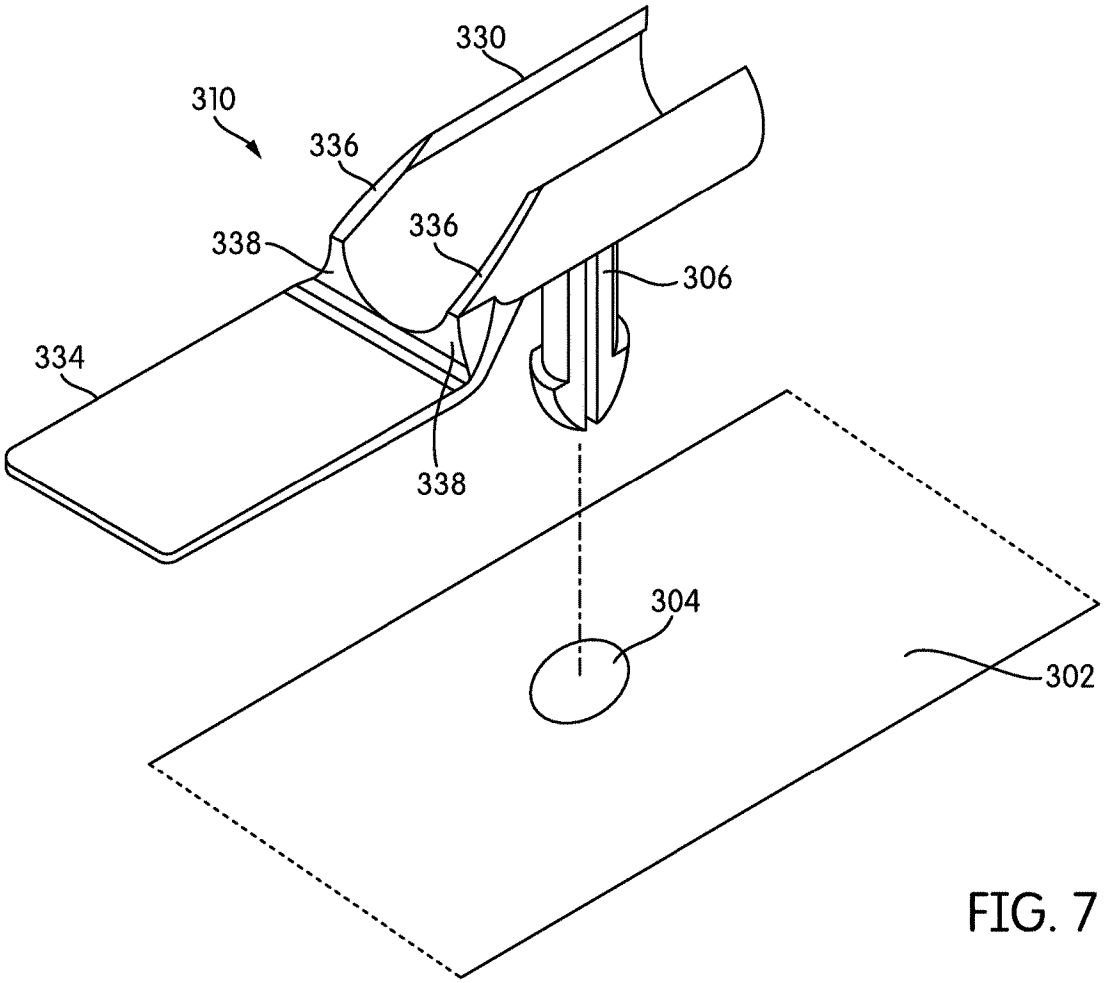
FIG. 7 is a perspective view of a joint support and strain relief with another type of external attaching structure.

Other types of attaching structures may be integrated with the joint support. As another example, FIG. 7 illustrates a joint support and strain relief 310. The joint support and strain relief 310 has many of the same features as those of the previously-described embodiments, including a cuff portion 330 and a spade portion 334. The cuff portion 330 has setbacks 336 which transition into near-vertical end walls 338. Like the joint support 200, the joint support 300 also includes integral structure for attaching it to a substrate. In this case, the joint support 300 includes a split projection 306 attached to the underside of the cuff portion 330 and extends straight down from it. The split projection 306 is sized to be inserted into a hole 304 in a substrate 302. The head of the projection 306 is shaped such that as it enters the hole 304, the head acts as a cam—its shape bearing against the edges of the hole 304 causes the two halves to deflect inwardly, such that the projection 306 can enter the hole 304. Once in the hole 304, the projection 306 resiliently returns to its prior configuration, and the size of the head prevents the projection 306 from being withdrawn from the hole 304. While the joint support 310 is shown as having the same basic features as the joint support 10 described above, it may have sidewalls 104, tabs 106, and other such features as well.

Joint supports 10, 100, 200, 310 according to embodiments of the invention will typically be made of a rigid material, such as a rigid plastic. Moreover, in contrast to single-wire electrical spade connectors, the joint supports 10, 100, 200, 310 may be made of non-conductive materials. Acrylonitrile-butadiene-styrene (ABS) plastics are one suitable material. However, in some embodiments, the joint support 10, 100, 200, 310 may be made slightly more flexible, so that it can flex with the joint while supporting it. That may also help to eliminate the risk of failure of the strip light 14 at the forward edge of the spade portion 34. In that case, harder rubber resins and more flexible polymeric materials may be used, like high-density polyethylene and polypropylene. Of course, metals may be used in some embodiments, so long as conductive elements are prevented from touching and short-circuiting on the metal.

Thus, joint supports 10, 100, 200, 310 according to embodiments of the invention provide support for the entire joint between a strip light 14 and a power cord 12, in the process providing strain relief for the wires and the joint. They may also be used to facilitate alignment of the two pieces and to support them when they are soldered.

While the invention has been described with respect to certain embodiments, the description is intended to be exemplary, rather than limiting. Modifications and changes may be made within the scope of the invention, which is defined by the appended claims.

What is claimed is:

1. A joint support and strain relief, comprising:

a cuff portion with curved interior sidewalls that define a curved channel for a power cord and form a gap therebetween into which the power cord can be inserted, forward portions of the sidewalls having angled setbacks that allow the forward portions of the sidewalls to taper to a fraction of a total height of the channel; and a spade portion, in the form of a thin, flat generally rectangular plate, contiguous with the forward portions of the sidewalls and extending forwardly therefrom at a height generally equal to or just below a floor of the channel;

wherein the joint support and strain relief is made of a nonconductive material.

2. The joint support and strain relief of claim 1, wherein the joint support and strain relief is made of a generally rigid material.

3. The joint support and strain relief of claim 2, wherein the material comprises an acrylonitrile-butadiene-styrene (ABS) plastic.

4. The joint support and strain relief of claim 1, wherein the joint support and strain relief is made of a flexible material.

5. The joint support and strain relief of claim 1, wherein the setbacks are truncated with substantially vertical forward walls.

6. The joint support and strain relief of claim 1, wherein the height of the spade portion is just below the floor of the channel.

7. The joint support and strain relief of claim 1, wherein the curved interior sidewalls are resilient and are adapted to snap-fit around the power cord.

8. The joint support and strain relief of claim 1, wherein the spade portion comprises sidewalls arising vertically from left and right sides, respectively.

9. The joint support and strain relief of claim 8, wherein the spade portion comprises at least one tab extending generally horizontally inward from a top edge of one of the sidewalls.

10. The joint support and strain relief of claim 9, wherein the spade portion comprises two inwardly-extending tabs positioned opposite one another.

* * * * *